US006155850A

United States Patent [19]

Martin et al.

[11] Patent Number: 6,155,850

[45] Date of Patent: Dec. 5, 2000

[54] CAM SLIDE ELECTRICAL CONNECTOR

[75] Inventors: Galen Martin, Troy, Mich.; Anthony Robert Hirko, Summerfield, N.C.; Forrest Irving Kinsey, Jr., Harrisburg, Pa.

[73] Assignee: The Whitaker Corporation, Wilmington, Del.

[21] Appl. No.: 09/160,400

[22] Filed: Sep. 25, 1998

[51] Int. Cl.[7] ..... H01R 13/62

[52] U.S. Cl. ..... 439/157

[58] Field of Search ..... 439/157, 152, 439/153, 595, 437, 347, 352, 151

[56] References Cited

U.S. PATENT DOCUMENTS

| | | | |
|---|---|---|---|
| 4,875,873 | 10/1989 | Ishizuka et al. | 439/347 |
| 4,921,437 | 5/1990 | Cooper et al. | 439/275 |
| 4,973,268 | 11/1990 | Smith et al. | 439/595 |
| 5,076,806 | 12/1991 | Hotea et al. | 439/595 |
| 5,104,045 | 4/1992 | Kah | 239/246 |
| 5,244,400 | 9/1993 | Hatagishi | 439/157 |
| 5,326,274 | 7/1994 | Pfaff et al. | 439/157 |
| 5,350,313 | 9/1994 | Woller | 439/347 |
| 5,478,251 | 12/1995 | Jaklin | 439/157 |
| 5,593,326 | 1/1997 | Listing | 439/752 |
| 5,618,194 | 4/1997 | Maue et al. | 439/157 |
| 5,681,175 | 10/1997 | Busse et al. | 439/157 |
| 5,766,026 | 6/1998 | Cooper et al. | 439/76.1 |
| 5,876,226 | 3/1999 | Tsukakoshi et al. | 439/157 |

FOREIGN PATENT DOCUMENTS

| | | | |
|---|---|---|---|
| 0 631 347 A2 | 12/1994 | European Pat. Off. | H01R 13/627 |
| 0 722 203 A1 | 7/1996 | European Pat. Off. | H01R 13/629 |
| 195 32 623 A1 | 3/1997 | Germany | H01R 13/629 |

OTHER PUBLICATIONS

AMP Customer Drawing, Plug Assembly, 25 Position, Drawing No. C–776088, Jun. 7, 1995.

*Primary Examiner*—Renee S. Luebke
*Assistant Examiner*—Chandrika Prasad

[57] ABSTRACT

An electrical connector assembly includes a plug connector 2 and a mating connector or printed circuit board header 94 that are mated with the assistance of a cam slide 4. Channels in which the cam slide 4 shifts are formed by top rails 26 that are staggered relative to bottom rails 30 so that the rails can be formed by straight pull mold tooling without side pulls. The cam slide 4 can be inserted from opposite ends of the plug connector housing 20. At least some of the power terminals 86 are located separately from signal terminals 88 so that they can be separately sealed. A combined terminal position assurance member and seal retainer 74 is latched to the plug connector housing on the inside of power terminal cavities 52 so as not to interrupt the sealing integrity.

23 Claims, 10 Drawing Sheets

50
38
50
52
52
74
2
24
26
26
46
54
42
22
48
28
26
70
20
26
34
36
12
40
6
4
12
16
8
10

50
38
18
18
50
30
32
2
25
44
20
30
40
4

CAM SLIDE ELECTRICAL CONNECTOR

BACKGROUND OF THE INVENTION

1. Field of the Invention

This invention is related to electrical connectors. This electrical connector included a laterally shiftable member or cam slide that is used to apply mating force between two connectors. This electrical connector is also a sealed electrical connector including separately sealed compartments.

2. Description of the Prior Art

Cam slides are used to increase the force available to mate two electrical. U.S. Pat. No. 5,478,251 is an example of a plug connector that uses a laterally shiftable cam slide that includes cam slots which engage cam follower pins. U.S. Pat. No. 5,618,194 is another example of an electrical connector that includes a laterally shiftable cam slide. Prior art connectors of this type have been used to connect automotive wiring harnesses to components in motor vehicles. For example, a cam slide connector of this type could be employed as part of an anti-lock braking system of the type shown in U.S. Pat. No. 5,766,026.

Electrical connectors of this type are typically sealed and include multiple signal terminals and power terminals having a current rating and a size greater than that of the signal terminals. In some cases, separate connectors are employed to connect power and signal wires to multiple input/output headers on an electronic module. However, space is often a consideration, so that it is desirable that as many terminations as possible be made in the same connector. However, when the same connector must include power terminals, seals and a force augmenting member such as a cam slide it becomes more difficult to incorporate them all into a relatively simple connector. Since simpler connectors are as a rule less expensive to manufacture so it is important to keep the connectors as simple as possible. For example, if the connector and component housings can be molded by the use of simple straight pull tooling, without side cores, the connector can be more cost effectively manufactured. Elimination of molding operations in which sections of the mold must travel for a relatively long distance when the part is extracted from the mold will also reduce cost and improve the reliability of the mold tooling. For example, one prior art cam slide connector included a channel in which the cam slide is shiftable. This channel extends along the entire length of the rectangular connector housing. The channel is formed by blades on the mold which shift in a direction parallel to the longest dimension of the connector housing making the tooling travel relatively long and reducing the density of the cavities in the mold.

SUMMARY OF THE INVENTION

The invention described in terms of the representative embodiment depicted herein combines a cam slide with sealed connectors in which the principal molded components of the connectors can be manufactured without side pulls or long core pins or mold sections that must be moved a great distance during molding.

This invention also permits selected power terminals to be located in a separate compartment from the signal terminals. The power terminals can be separately sealed and a failure of a seal surrounding these power terminals will not adversely affect the signal circuits.

Another advantage of this cam slide connector is that the cam slide can be inserted into either end of the cam slide channel. This connector can therefore be use in different applications because the cam slide actuator can be inserted from the direction where surrounding components permit the most clearance. Conversely, the use of this connector will also permit other components to be located with less concern for interference with the connector.

This invention comprises a cam slide electrical lug connector matable with a mating connector. The cam slide connector includes a molded housing, electrical terminals, and a cam slide shiftable to move the plug connector to a fully mated position with the mating connector. The plug connector housing includes top molded rails staggered laterally relative to bottom molded rails. The top and bottom rails can be molded by sections of a molding cavity shiftable parallel to the terminal cavities and perpendicular to top and bottom surfaces of the housing, and therefore perpendicular to the longest dimension of the housing. These top and bottom rails support the cam slide as the cam slide moves the plug connector to the fully mated position. The cam slide can also be inserted into channels formed by the rails from opposite ends of the housing.

Alternatively, a cam slide electrical connector comprising this invention a connector housing has a mating face and a rear face including housing body containing multiple terminal cavities. A rear wall extends beyond opposite sides of the housing body, and sidewalls extend from the rear wall toward the mating face. The sidewalls are spaced from the housing body to form channels between the sidewalls and the housing body. The sidewalls include rail segments extending inwardly toward the housing body adjacent the mating face and openings in the rear wall staggered relative to the rail segments. A cam slide is shiftable in the channels. The cam slide is held in the channels by the rail segments and by portions of the rear wall extending between the housing body and the sidewalls between the openings.

The preferred embodiment of this electrical connector assembly also comprises terminals, a housing with a resilient terminal latch, and cavities containing sealing surfaces that are engaged by seals attached to the terminals. A combination terminal position assurance member and seal retainer holds interfacial seals surrounding some of the terminals. The housing includes a pair of side by side cavities extending between a front and rear surface of the housing. The terminals are positioned in each housing cavity with each terminal attached to a wire. The resilient latch extends into each cavity toward the front surface. This resilient latch functions as a primary latch to secure each terminal into the corresponding cavity. Pockets at the rear of each cavity include peripheral surfaces separately engagable with wire seals surrounding individual wires attached to each terminal. The terminal position assurance member is attachable on the front surface of the housing and surrounds the pair of cavities. The terminal position assurance member includes a projection extending into each cavity. The projection supports a corresponding resilient latch when fully inserted. Each cavity includes at least one shoulder adjacent to each resilient latch and the terminal position assurance member includes at least one snap latch engagable with a corresponding shoulder to attach the terminal position assurance member to the connector housing without adversely affecting the sealing integrity of the connector.

DETAILED DESCRIPTION OF THE PREFERRED EMBODIMENT

Cam slide plug connector 2 shown in FIGS. 1–8 is an electrical connector that is mated with a mating connector or printed circuit board header 94 shown in FIGS. 9–12 with the assistance of a cam slide 4 that shifts laterally relative to connector 2 and header 94 as the two connectors are mated. The cam slide 4 provide additional force to mate the two connectors, each of which contain a large number of terminals. Throughout the description of this invention, the terms top and bottom have been used to refer to the relative position of portions of the plug connector and the cam slide if the plug connector 2 is mated to the printed circuit board header 94 from below. Although the two connectors halves can be assembled in almost any orientation, this orientation is believed to be a typical orientation of the components when in actual use. The top is on the mating face of the connector and the bottom is on the opposite face of the housing. The terms top and bottom have not been used to refer to the orientation of the components in the various figures. The orientation of the figures has been chosen to best illustrate the structure of the two connectors, their opposite faces, and their component parts. However, the top is located on the right in FIGS. 1–6 and the bottom is located on the left.

Figure 1:
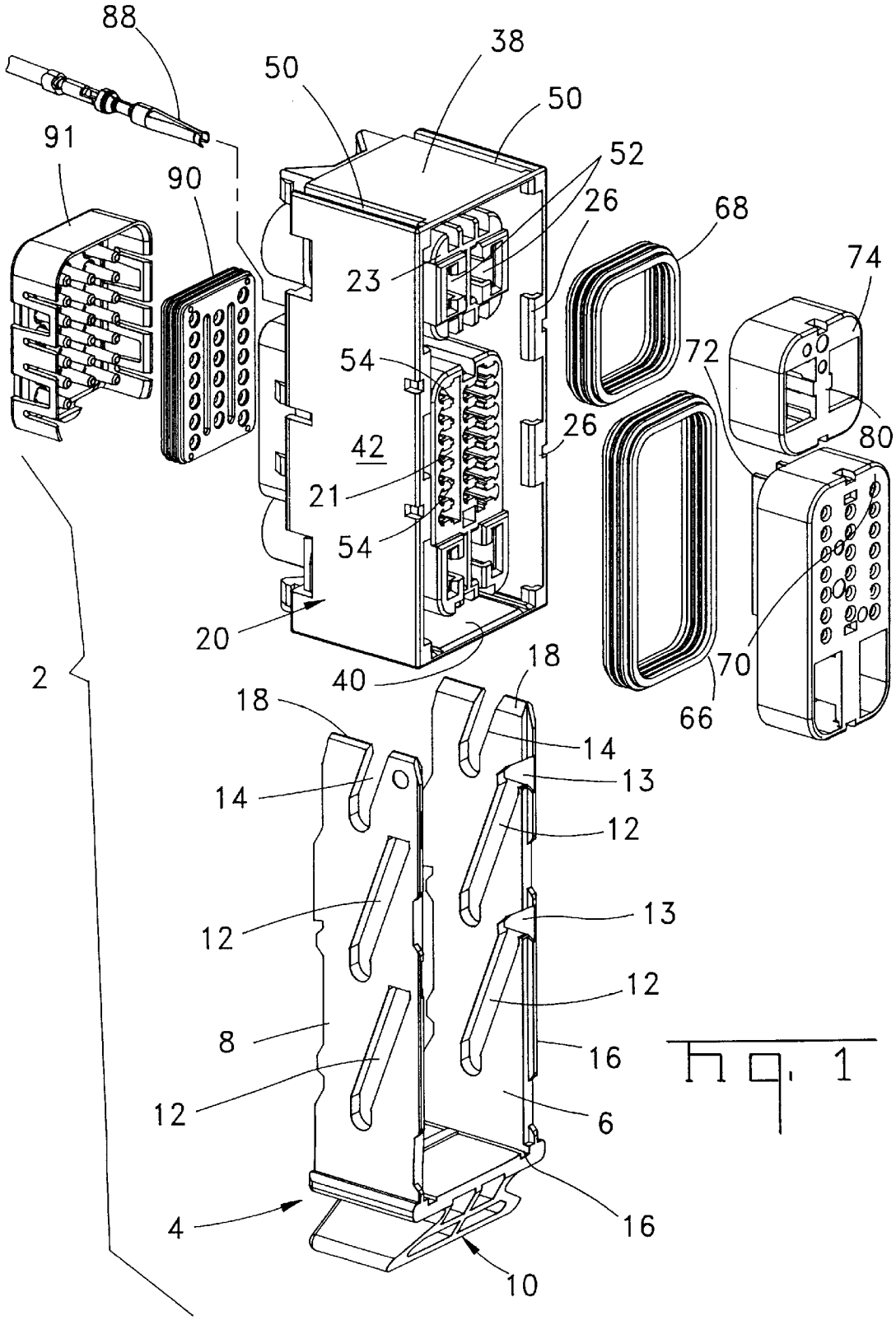
FIG. 1 is an exploded three dimensional view of a cam slide plug connector in accordance with the preferred embodiment of this invention.
Figure 2:
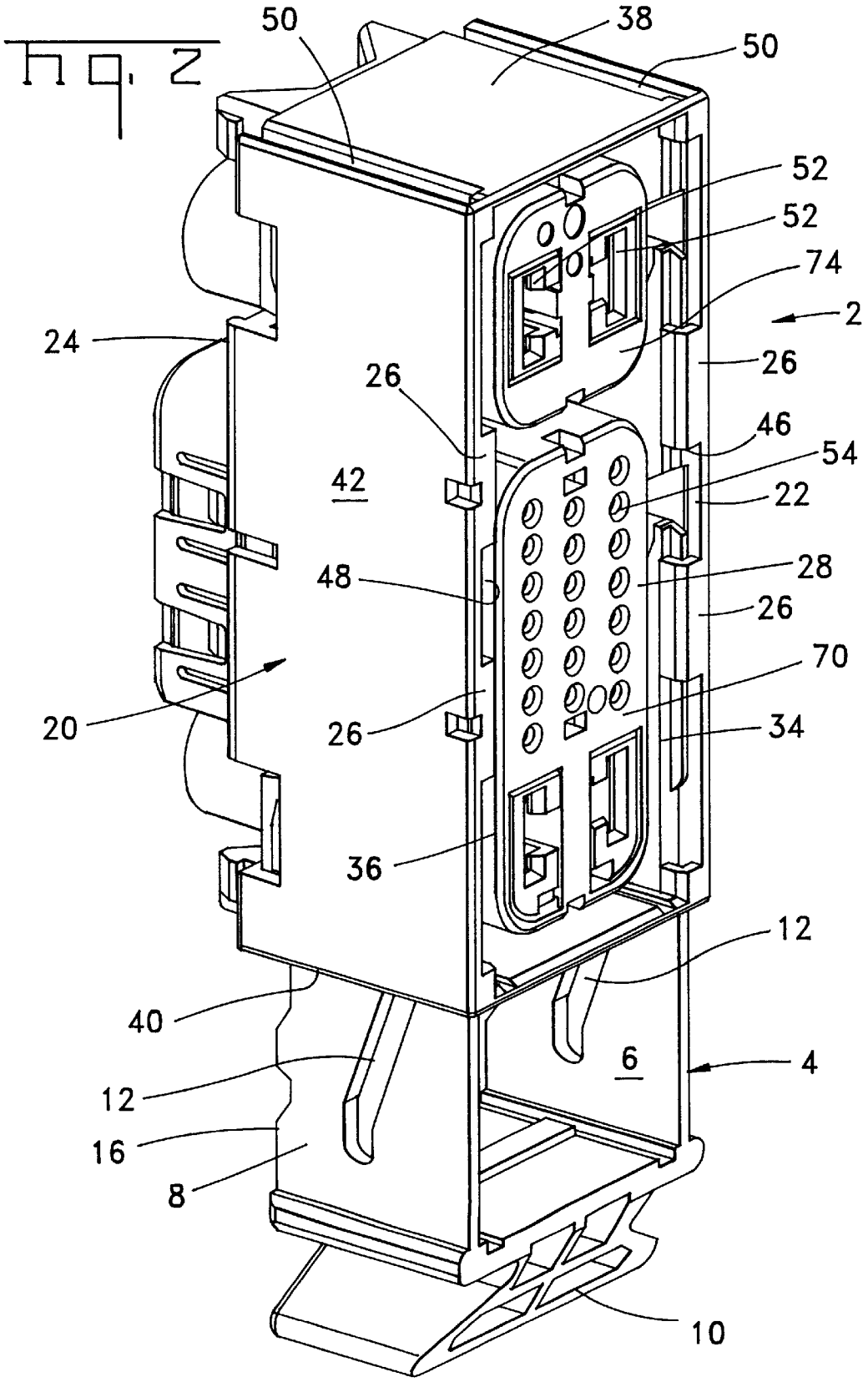
FIG. 2 is a three dimensional view of the mating face of the cam slide connector of FIG. 1 with the cam slide in an extended position.
Figure 3:
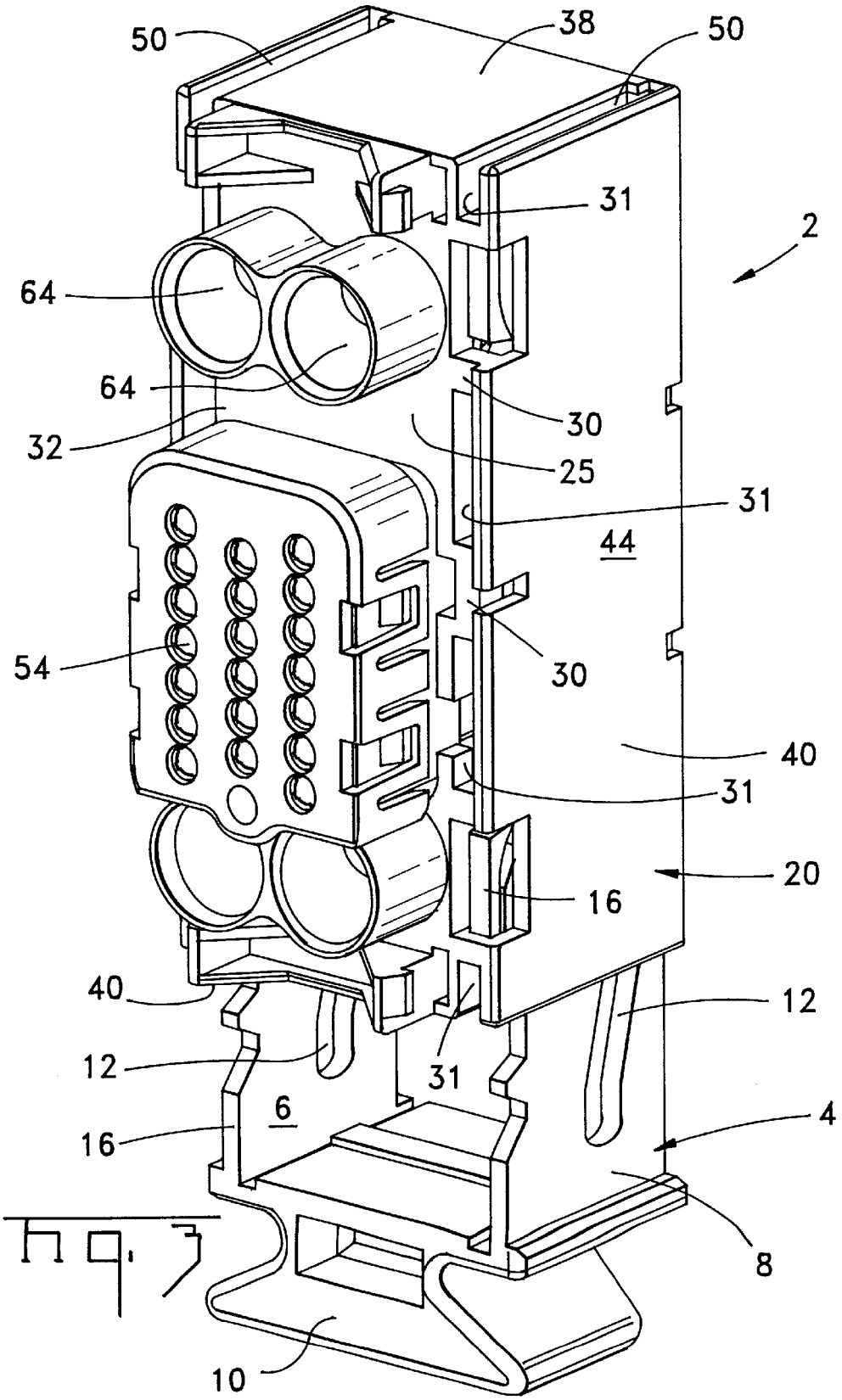
FIG. 3 is a three dimensional view of the rear face of the cam slide connector of FIG. 1 with the cam slide in an extended position.
Figure 4:
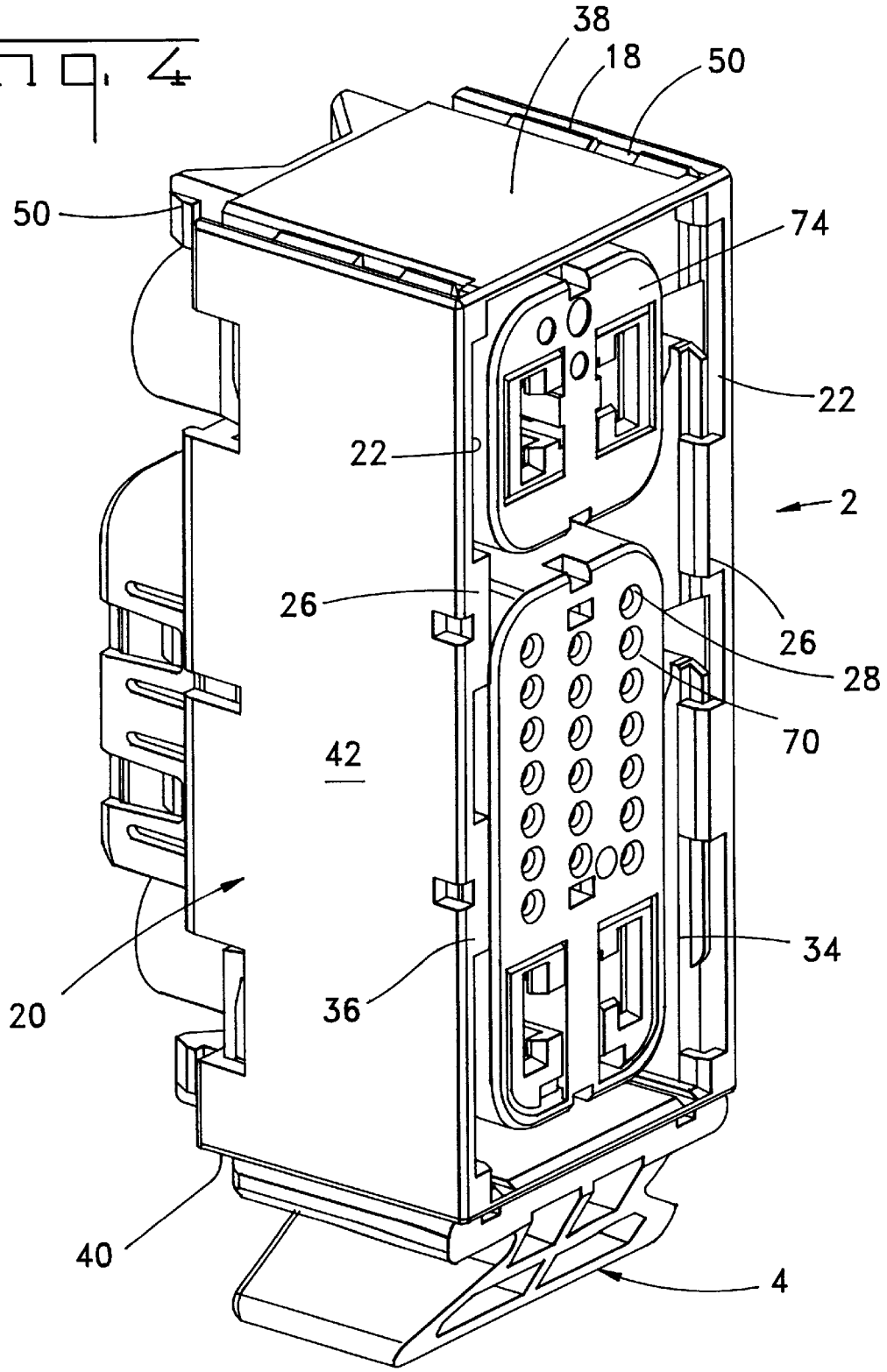
FIG. 4 is a three dimensional view of the mating face of the cam slide connector with the cam slide in the closed position.
Figure 5:
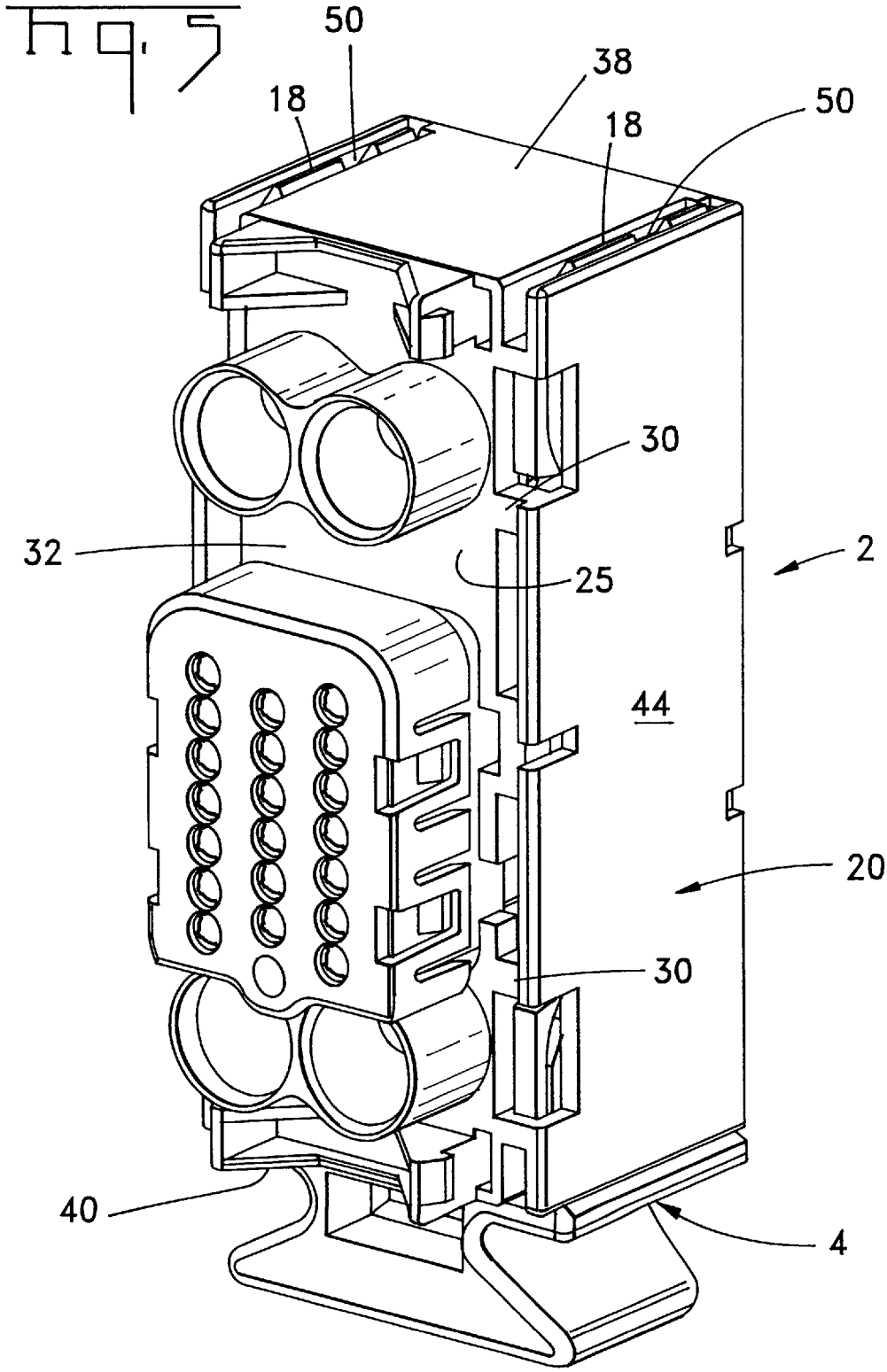
FIG. 5 is a three dimensional view of the rear face of the cam slide connector with the cam slide in the closed position.
Figure 6:
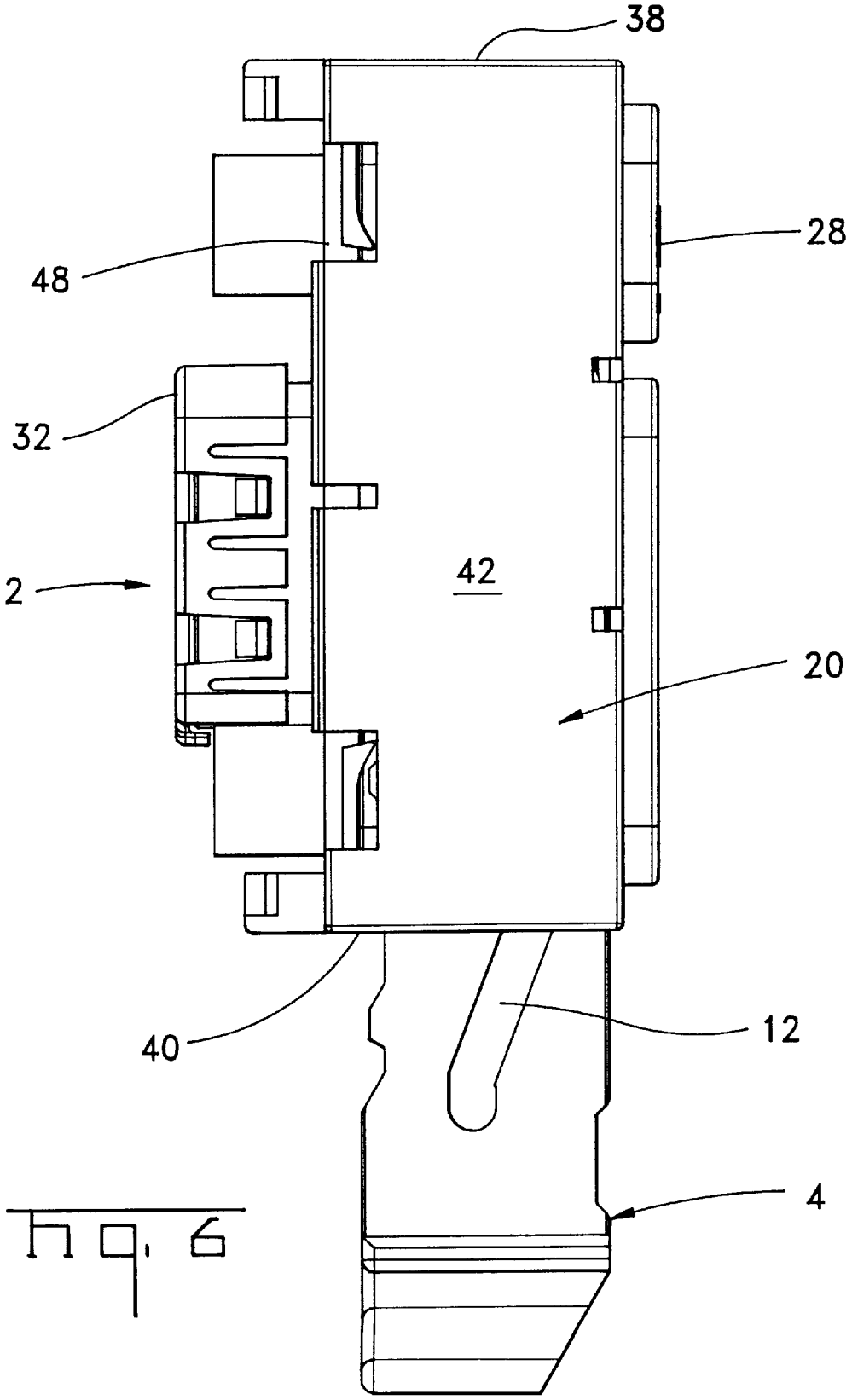
FIG. 6 is a side view of the cam slide connector with the cam slide in the extended position.
Figure 7:
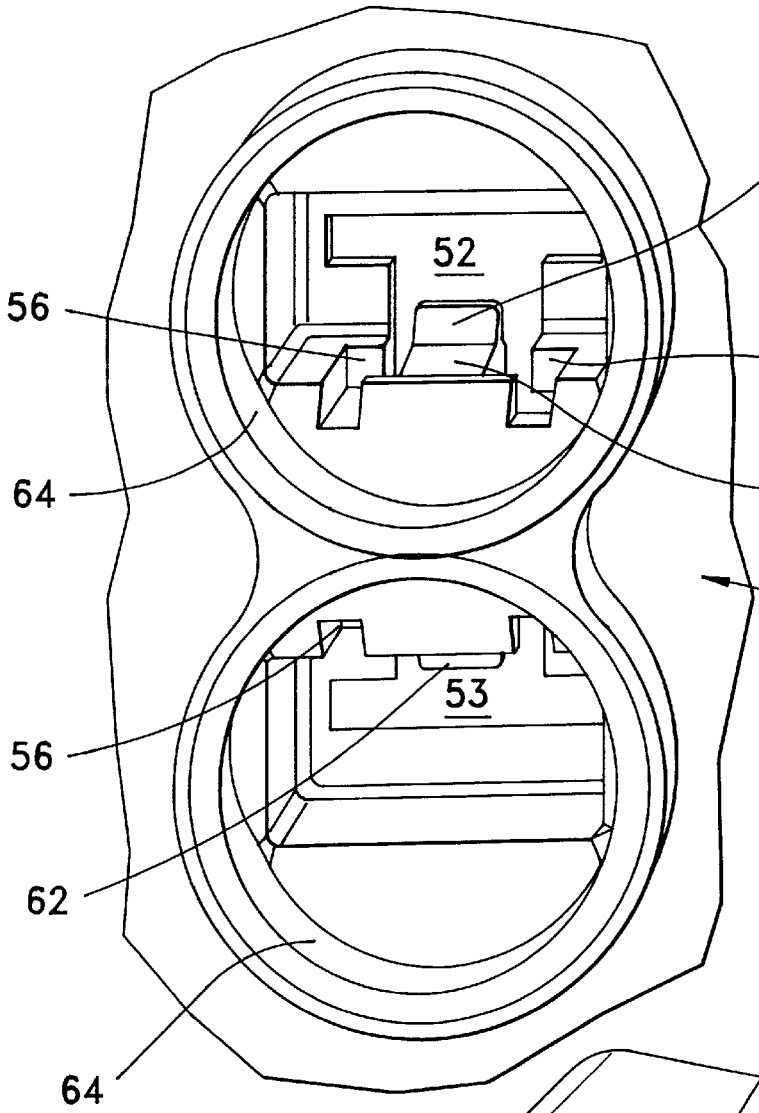
FIG. 7 is a view of a pair of seal pockets for power terminals on the rear of the connector and showing the resilient latch and TPA latching shoulders in a power terminal cavity.
Figure 9:
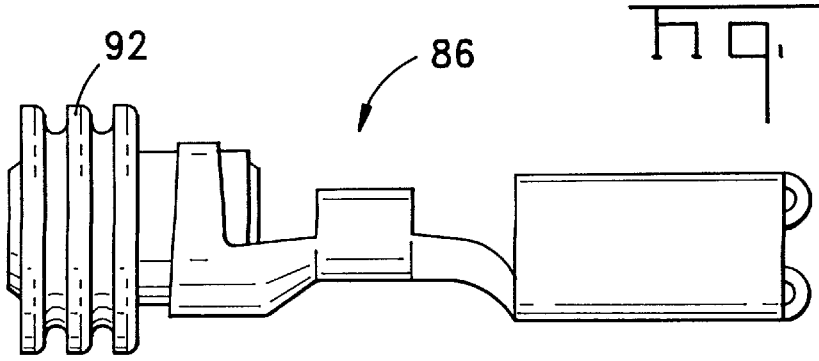
FIG. 9 is a side view of a power terminal showing a single seal secured at the rear of the terminal receptacle section.
Figure 11:
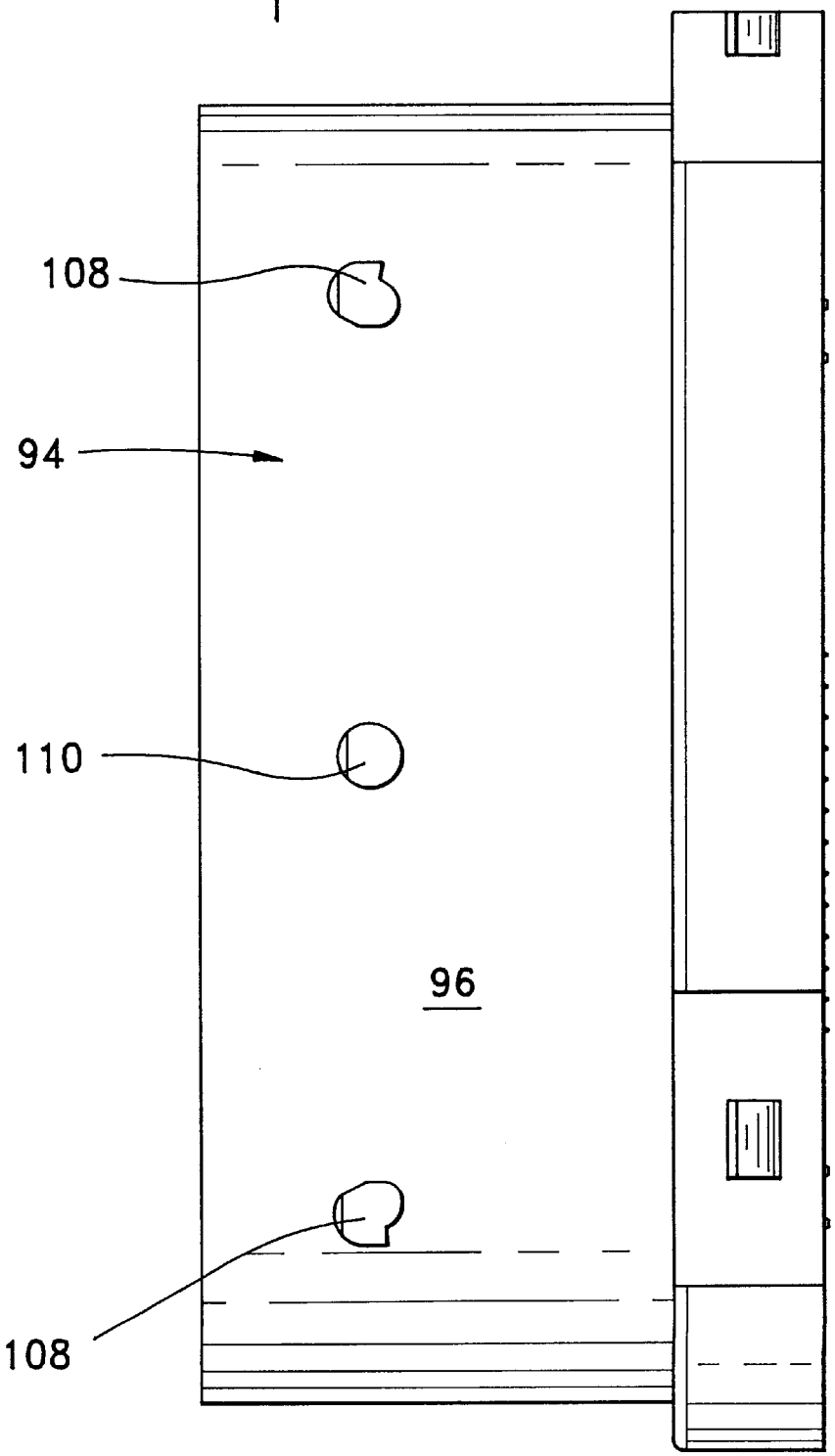
FIG. 11 is a side view of the header shown in FIG. 10.
Figure 12:
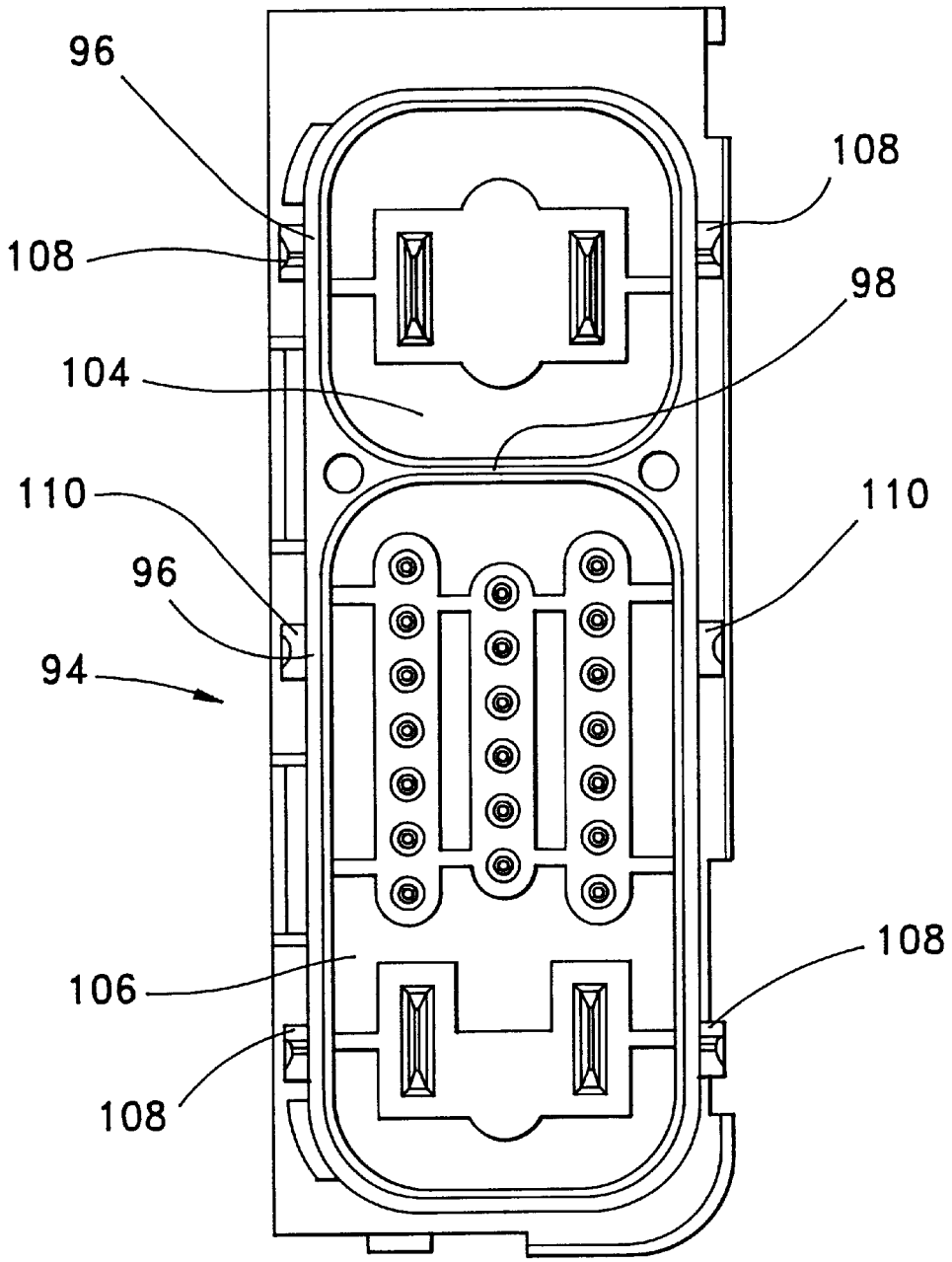
FIG. 12 is a top view of the header of FIGS. 10 and 11 showing two arrays of openings in which male pins or blades are positioned.

The components of the cam slide plug connector 2 are shown in FIG. 1. The terminals that are inserted into plug connector housing 20 are not shown in FIG. 1. These terminals are of conventional construction and this invention can be used with electrical connectors employing a wide variety of terminals. A power terminal 86 used in this invention is shown in FIG. 9 and a standard signal terminal, such as Part Number 770756 manufactured by AMP Incorporated, can be employed.

The cam slide 4 used in this invention is a molded plastic part. This cam slide can be injection molded from a material such as glass filled polybutylene thermoplastic (PBT), although other materials would be satisfactory. Cam slide 4 includes a first cam slide plate 6 and a parallel second cam slide plate 8, each of which extend from the edges of a center web or actuator 10. This central actuator 10 is configured to be pushed by an installer to insert the cam slide 4 or grasped by a maintenance technician to remove the cam slide 4 for separating the two mated connectors. Each cam slide plate 6 and 8 includes three cam slide slots. Two cam slide slots 12 extend from the bottom edge 16 of the cam slide plates 6 and 8. The third cam slide slot 14 is shorter in length and extends from a leading edge 18 extending generally perpendicular to bottom edge 16 on each plate 6, 8. Of course suitable draft, on the order of three degrees, is provided so that the leading edge 18 normally would not be exactly perpendicular to the bottom edge 16. Each of the cam slide slots 12, 14 is angled so that as the cam slide 4 is moved laterally relative to both the plug connector 2 and the mating header 94, shown in FIGS. 10–12, cam pins or cam followers 108, 110 located on the exterior of the header 94 move in the cam slots 12, 14 so that the plug connector 2 is progressively urged toward the header 94 during mating.

The cam slide 4 is insertable into plug connector housing 20 from either of two ends. The housing 20 is injection molded and is fabricated from a plastic such as glass filled PBT. Other thermoplastic resins could also be employed. Housing 20 includes a signal terminal housing body 21 and a power terminal housing body 23, each of which extend between top or mating edges 22 and bottom or rear edges 24. Housing bodies 21 and 23 extend from a rear housing wall 25. The housing 20 also includes a first sidewall 42 and a second sidewall 44 extending from the rear housing wall 25 on opposite sides of the housing bodies 21 and 23. The sidewalls 42 and 44 are spaced from the housing bodies 21 and 23 to form a first cam slide channel 46 and a second cam slide channel 48. Top rails 26, comprising molded extensions of the sidewalls 42 and 44, are located on the mating edge 22 of the housing 20. Separate top rails segments 26 are spaced apart along this edge of the sidewalls 42 and 44. Bottom molded rails 30 are located at the rear of the sidewalls 42 and 44, and comprise extensions of the rear housing wall 25 that join the sidewalls 42 and 44 to the rear housing wall 25. These rear or bottom rails 30 are separated by openings 31 that are aligned with the front or top molded rail segments 26. The openings 31 provide clearance for sections of a mold that are used to form the rails 26 located along the mating face 28 of the housing 20. By offsetting or staggering the front rails 26 and the bottom rails 30 these rails can be molded by straight pull mold tooling that shift from the front and back of the housing 20 or the mold cavity used to form the housing 20.

The rails 26 and 30 retain the cam slide plates 6 and 8 in the cam slide channels 46 and 48. The cam slide plates 6 and 8 can be inserted into cam slide channels 46 and 48 through end channel slots 50 located on both ends of each of the channels 46 and 48. In other words, the cam slide 4 can be assembled to the plug connector housing 20 from either end so that the cam slide actuator 10 can be located at either end of the plug housing 20.

Plug connector 2 is a sealed electrical connector. A peripheral seal 66 surrounds the signal terminal housing body 21 and the terminals located in the signal terminal cavities 54 extending between the mating face 28 and the rear face 32. The peripheral seal 66 also extends around terminal cavities located in the housing body 21. Two power terminal 86 located in body 21 function as battery ground terminals. Another separate peripheral seal 68 surrounds the power terminal housing body 23 which contains two power terminals 86 that are separated from the array of signal terminals 88 in the housing body 21 and from the power terminals located in body 21. In the ABS system in which this connector is to be used, these two power terminals comprise positive battery terminals. In other words the power terminals 86 in housing body section 23 are separately sealed from the terminals in the signal terminal housing body 21. Therefore a seal lead will not lead to an electrolytic reaction between positive and negative or ground battery terminals. Both peripheral seals 66 and 68 are of conventional construction and are substantially the same as other seals used at the interface of plug connectors and mating connectors, such as printed circuit board headers. A single mat seal 90 is located at the rear of the plug connector housing 20. This seal 90 includes a plurality of openings, each receiving a separate signal terminal 88, which can be smaller than a terminal 86 and can have a lower current rating. A seal retainer 91 secures the seal 90 to the rear of the plug connector housing 20.

The peripheral seals 66 and 68 located on the mating face 28 of the plug connector 2 are held in position by seal retainers 70 and 74. In addition to functioning as seal retainers, these molded components 70 and 74 also function as terminal position assurance (TPA) members. Signal terminal TPA 70 includes a wedge or projection 72 that is inserted between signal terminal housing cavities 54 to support a signal terminal resilient latch, not shown, that secures a signal terminal 88 in a corresponding cavity. This signal terminal TPA 70 functions in a conventional manner.

Figure 8:
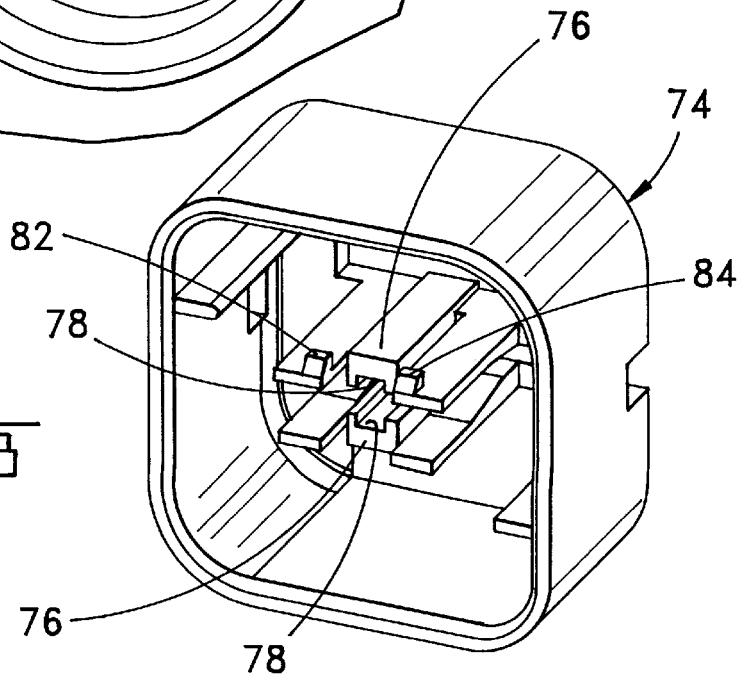
FIG. 8 is a view of the interior of a terminal position assurance member and seal retainer for a pair of power terminals.
Figure 10:
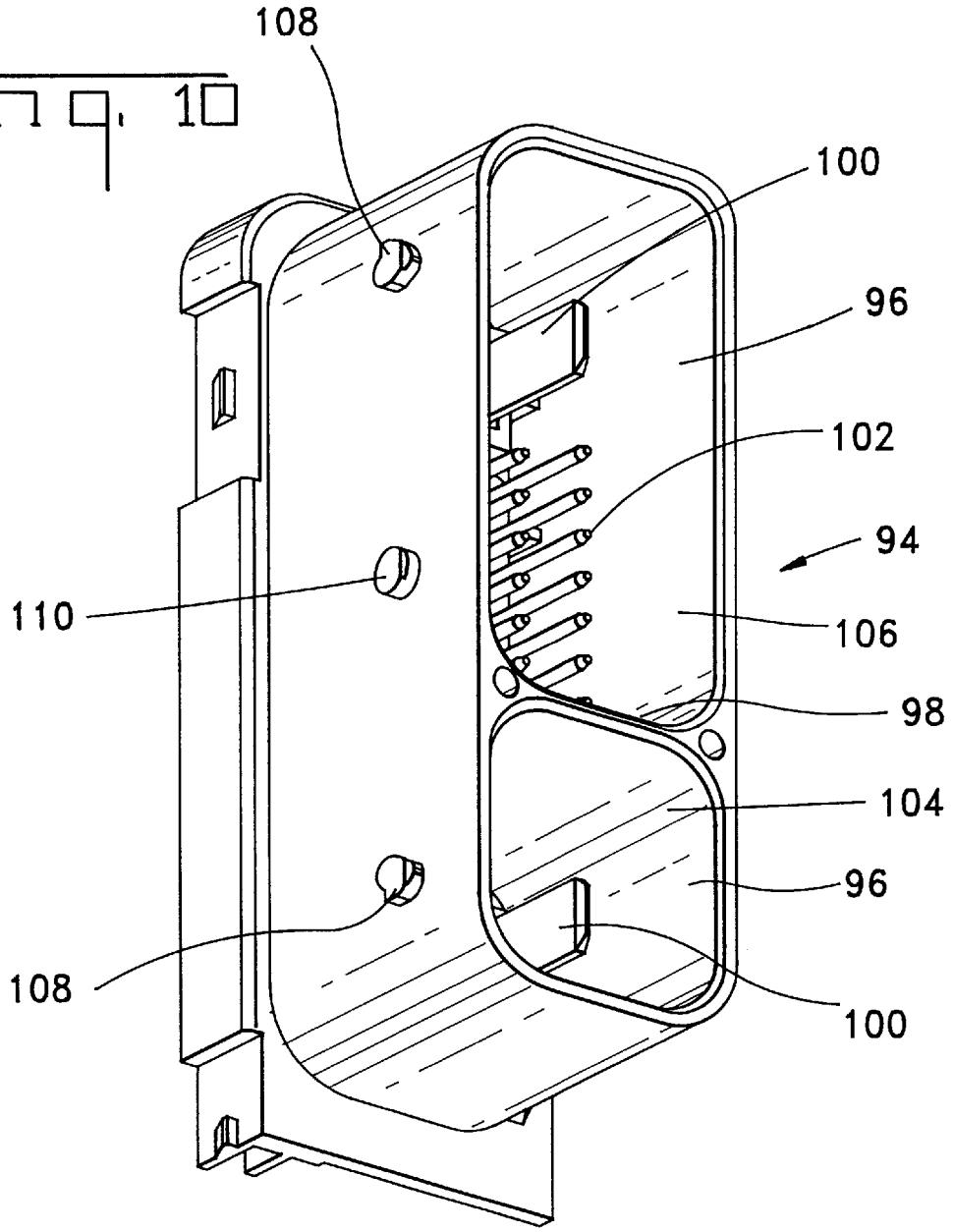
FIG. 10 is a three dimensional view of a shrouded printed circuit board header with which the cam slide plug connector is matable.

The power terminal TPA and seal retainer 74 is shown in more detail in FIG. 8. This TPA member 74 provides secondary locking or terminal position assurance for two power terminals of the type shown in FIG. 9 positioned within a pair of power terminal housing cavities 52 shown in FIG. 7. The power terminal housing cavities 52 each include a molded resilient terminal latch 60 that comprises an extension of the molded plug connector housing 20. These latches 60 each include a protruding lip 62 on the distal end of the latch 60 that is received within a lateral opening on the power terminal 86 when the terminal 62 is fully inserted into its corresponding cavity 52. When each resilient latch 60 is in its normal position securing a terminal 60 in place, a TPA projection or wedge 76 on TPA member 74, having a groove 78 on its internal side, can be positioned behind the corresponding latch 60 to support the latch. The two projecting wedges 76 will fit between the two resilient latches 60 on the pair of adjacent cavities 52. However, when a terminal 86 is only partially inserted into its cavity 52, the resilient latch 60 will be in an extended position. In that extended position, the latch 60 will abut wedge 76 when the combination terminal position assurance and seal retainer member 74 is inserted from the front or mating face 28 of the plug connector housing 20. Therefore, unless both power terminals 86 are fully inserted, the TPA member 74 cannot be fully inserted into place on the front of the housing 20.

The TPA member 74 can be held on plug connector housing 20 in two distinct positions by snap latches 82 and 84 on opposite sides of each wedge projection 76. The wedge projections 76 and the snap latches 82 and 84 each protrude rearwardly from a center web section 80, best seen in FIG. 1. Two openings are located on opposite sides of the central web 80 where they will be in alignment with a pair of power terminal cavities 52. These wedge projections 76 engage shoulders 56 and 58, located on opposite sides of each latch 60 in each cavity 52. Shoulder 56 is closer to the mating face of the housing 20 than shoulder 58. Therefore snap latch 84 will engage shoulder 56 when the TPA member 74 is in an extended or partially inserted position. Snap latch 82 will engage deeper shoulder 58 when the TPA member 74 is in the fully inserted position, with the wedges 76 located behind the corresponding latches 60. When the TPA member 74 is in the partially inserted position, the latch 60 is free to deflect and the terminals 86 can be inserted into cavities 52. The latches 82 and 84 and the shoulders 56 and 58 are located on the inside of cavities 52 so that they can be between the peripheral seal 68 on the front of the connector 2 and the wire seals 92 on each power terminal 86. These individual wire seals 92 are crimped to the terminals 86 before the terminals are inserted into the cavities 52. The seals 86 engage cylindrical peripheral sealing surfaces 64 in pockets located at the rear of the cavities 52 and protruding from the rear face of the housing 20. The latches 60, the shoulders 56 and 58 can be molded by mold sections moving along the same axis without side pulls. The snap latches 76 and 78 can also be molded without side pulls.

Two power terminals 86 can be located in an array separate from the signal terminals 88, and other terminals in the second array to permit the circuits employing these power terminals 86 can be separately sealed. In a connector used in an anti-lock braking system (ABS) in an automobile, these power terminals 86 may be connected to the battery and these battery leads should be separated from the sealing integrity maintained around the remainder of the circuits in the ABS system.

The plug connector 2 is configured to mate with a mating connector in the form of a shrouded printed circuit board header 94. This header 94 includes power blades or pins 100 and smaller signal blades or pins 102 located in two separate arrays 104 and 106 for mating with the receptacle power terminals 86 and receptacle signal terminals 88 in the plug connector 2. These blades or pins 100 and 102 are located within cavities formed by the peripheral header shroud 96 and by a single internal wall 98 extending between opposite sides of the shroud. The interior surfaces on the shroud and the wall 98 form sealing surfaces that are engaged by the peripheral seals 66 and 68 on plug connector 2. The internal wall 98 extends between the two peripheral seals 66 and 68 so that sealing integrity is established for the two separate arrays of terminals on opposite sides of this single internal wall 98.

The shrouded printed circuit board header 94 also includes cam follower pins 108 and 110 located on opposite external sides of the shroud 96. The outer sets of pins 108 are identical and are equally spaced from the ends of the header shroud 96. These outer pins 108 are dimensioned so that they will fit in either cam slide slots 12 or 14 on the cam slide 4. The center cam follower pin 110 will fit within the center cam slide slot 12. The cam follower pins are symmetrically spaced on the header 94 so that they will enter cam slide slots 12 and 14 when the cam slide 4 is shiftable in opposite directions. The two connectors are mated by first placing the plug connector 2 over the header 94 with the cam follower pins 108, 110 aligned with the entry of the cam slide slots 12 and 14 when the cam slide 4 is in the extended positions shown in FIGS. 2 and 3. Note that in this position, the interior pin 108 will be aligned with the slot 14 exiting on the leading edge 18 of the cam slide 4, while the two other pins will be aligned with the cam slide slots 12 exiting along the bottom edge 16. These cam slide slots 12 include an entry section 13 that does not extend entirely through the corresponding cam slide plates 6, 8. Although the two connectors 2 and 94 can only be mated in one orientation, the cam slide 4 can be inserted from either end. This capability permits use of the same connector in different applications adjacent protruding structures that might otherwise interfere with actuation and movement of the cam slide 4. As the cam slide 4 is shifted from the extended position shown in FIGS. 2 and 3 to the fully inserted position shown in FIGS. 4 and 5, the plug connector 2 is moved relative to the printed circuit board header 94 to the fully mated configuration. The force required to mate these two connectors is provided by the travel of the cam slide 4 and the pins 108 and 110 in cam slide slots 12 and 14.

The preferred embodiment depicted herein is of course only representative of the invention which is defined by the claims, and numerous equivalent modifications could be made by one of ordinary skill in the art without departing from the inventive concepts disclosed herein.

We claim:

1. A cam slide electrical plug connector matable with a mating connector comprising a molded housing, electrical terminals and a cam slide shiftable to move the plug connector to a fully mated position with the mating connector, the plug connector being characterized in that the housing includes top molded rails staggered laterally relative to bottom molded rails so that the top and bottom rails can be molded by sections of a molding cavity shiftable perpendicular to top and bottom surfaces of the housing, the cam slide being supported by the top and bottom rails as the cam slide moves the plug connector to the fully mated position.

2. The cam slide plug connector of claim 1 wherein top and bottom rails are each located on two opposite sides of the housing.

3. The cam slide plug connector of claim 2 wherein the cam slide is shiftable laterally to a mating direction in which the plug connector moves into engagement with the mating connector.

4. The cam slide plug connector of claim 3 wherein the cam slide moves between a housing body and sidewalls spaced from the housing body.

5. The cam slide plug connector of claim 4 wherein the top and bottom rails extend between the housing body and the sidewalls.

6. The cam slide plug connector of claim 5 wherein the sidewalls are separated from the housing body by channels on opposite ends of the housing so that the cam slide can be inserted through slots on opposite ends between the housing and the sidewalls.

7. The cam slide plug connector of claim 6 wherein the cam slide includes two plates inserted between the housing body and the sidewalls on opposite sides of the housing body, the plates including inclined cam slots into which cam follower pins on the sides of the mating connector can be inserted when the plug connector is mated to the mating connector.

8. The cam slide plug connector of claim 7 wherein each plate includes multiple cam slots.

9. The cam slide plug connector of claim 7 wherein at least one cam slot extends from a bottom edge of each plate and at least one other cam slot extends from a leading edge of each plate.

10. The cam slide plug connector of claim 1 wherein the cam slide is shiftable laterally relative to the terminals.

11. The cam slide plug connector of claim 1 wherein the top and bottom rails each comprise multiple segments.

12. The cam slide plug connector of claim 1 wherein the rail segments on the top rail are staggered relative to the rail segments on the bottom rail.

13. The cam slide plug connector of claim 1 wherein the height of the housing in less than the length of the housing.

14. The cam slide plug connector of claim 1 wherein the housing is matable with a printed circuit board header.

15. A cam slide electrical connector comprising a connector housing having a mating face and a rear face including housing body containing multiple terminal cavities, a rear wall extending beyond opposite sides of the housing body, and sidewalls extending from the rear wall toward the mating face, the sidewalls being spaced from the housing body to form channels between the sidewalls and the housing body, the sidewalls including rail segments extending inwardly toward the housing body adjacent the mating face and openings in the rear wall staggered relative to the rail segments, and a cam slide shiftable in the channels, the cam slide being held in the channels by the rail segments and by portions of the rear wall extending between the housing body and the sidewalls between the openings.

16. An electrical connector assembly comprising a plug connector matable with a printed circuit header, and a cam slide laterally shiftable relative to the plug connector and the printed circuit board header during mating of the plug connector and the printed circuit board header, the electrical connector assembly being characterized in that the cam slide is insertable into opposite ends of the plug connector in opposite directions.

17. The electrical connector assembly of claim 16 wherein the printed circuit board header includes a shrouded housing with cam pins protruding from at least one side of the shrouded housing, the cam slide including cam slots in which the cam pins travel as the plug connector is mated with the printed circuit board header.

18. The electrical connector assembly of claim 16 wherein the plug connector includes a plug connector housing with at least one cam guide channel extending between opposite ends of the plug connector housing so that the cam slide can be inserted into opposite ends of the cam guide channel and can travel in opposite directions during mating.

19. The electrical connector assembly of claim 16 wherein the plug connector includes a plug connector housing with staggered rails located along top and bottom edges of the plug connector housing to define a cam guide channel into which the cam slide can be inserted.

20. The electrical connector assembly of claim 19 wherein the rails are staggered so as not to overlap when viewed from above a top surface of the plug connector so that the rails can be molded by mold tooling shiftable perpendicular to the top surface as the plug connector housing is molded.

21. The electrical connector assembly of claim 16 wherein the cam slide includes a first cam slide slot extending at an angle from a first edge of the cam slide and a second cam slide slot extending at an angle from a second edge of the cam slide, the first edge and the second edge being mutually perpendicular.

22. The electrical connector assembly of claim 21 wherein the second edge comprises a leading edge of the cam slide.

23. The electrical connector assembly of claim 16 wherein the cam slide comprises two parallel plates located on opposite sides of the plug connector.

* * * * *